United States Patent [19]

Sedley et al.

[11] Patent Number: 4,676,083

[45] Date of Patent: Jun. 30, 1987

[54] LOCKING MECHANISM WITH ACTUATOR

[76] Inventors: Bruce S. Sedley, R.R. 1, Box 96, Koloa, Kauai, Hi. 96756; Armin Eisermann, Eichholz Strasse 14, 5620 Velbert 1, Fed. Rep. of Germany

[21] Appl. No.: 837,528

[22] Filed: Mar. 7, 1986

[51] Int. Cl.[4] ..... E05B 47/00

[52] U.S. Cl. ..... 70/276; 70/222; 70/277; 70/413; 192/89 B; 192/93 R

[58] Field of Search ..... 70/209, 218, 222, 223, 70/276, 277, 279, 413; 192/89 B, 89 R, 93 R, 93 C

[56] References Cited

U.S. PATENT DOCUMENTS

| | | | |
|---|---|---|---|
| 2,019,262 | 10/1935 | Kauffman | 70/413 X |
| 2,179,945 | 11/1939 | Maurer | 192/89 B |
| 2,485,214 | 10/1949 | Peterson et al. | 192/89 B X |
| 2,732,703 | 1/1956 | Noregaard | 70/276 X |
| 3,096,114 | 7/1963 | Trammell | 70/218 X |
| 3,266,278 | 8/1966 | Ennitt | 70/277 |
| 3,834,501 | 9/1974 | Adachii | 192/89 B X |
| 3,896,645 | 7/1975 | Nagy et al. | 70/223 X |
| 3,922,896 | 12/1975 | Kagoura | 70/223 |
| 3,995,460 | 12/1976 | Sedley | 70/276 X |
| 4,122,929 | 10/1978 | Maucher et al. | 192/89 B X |
| 4,125,008 | 11/1978 | Genest et al. | 70/279 |
| 4,133,194 | 1/1979 | Sedley | 70/218 X |
| 4,332,314 | 6/1982 | Flotow | 192/89 B |
| 4,371,062 | 2/1983 | Ohkubo | 192/93 R X |
| 4,375,253 | 3/1983 | Mott | 192/89 B |
| 4,520,913 | 6/1985 | Maucher et al. | 192/89 B X |

*Primary Examiner*—Thomas J. Holko
*Assistant Examiner*—Suzanne L. Dino
*Attorney, Agent, or Firm*—George J. Netter

[57] ABSTRACT

The lock housing has a slot in a top wall via which a coded card key can be inserted to bring into alignment coded magnetic areas on the card with magnetically responsive elements of the lock to unlock the locking mechanism and enable rotation of either a knob or lever arm to open the door. The card moves a spring actuator against a coupling spline to engage it with a spindle spline carried by a shaft interconnected with the knob or lever arm handle. The sliding coupling spline is integral with parts which interrelate with the door lock mechanism such that rotation of the knob or lever arm will now effect release of the door locking mechanism. When the card is fully inserted, the mechanism is maintained in the unlocked condition and the card may be released to turn the knob or handle with the same hand. Spring-loaded members separate the coupling and spindle splines as the magnetic card key is withdrawn from the housing slot. Once the internal lock mechanism is unlocked, it is maintained unlocked until the magnetic card has been withdrawn from the lock housing.

25 Claims, 7 Drawing Figures

3
3
25
24
15
38
33
19
20
22
23
51
35
10
29'
11
53
17
18
31
21
27
30
29
32
12
59
60
26
28
18'
61
62
33
65
46
45
40
43
44
41
64
42
63
47
48
49
39

LOCKING MECHANISM WITH ACTUATOR

The present invention relates generally to an improved magnetic key operated locking mechanism, and, more particularly, to electric switch activation as well as a door lock which acts upon the insertion of a properly coded magnetic key to effect interconnection of a door knob or handle with the door latch mechanism and when removed from the lock disconnects the knob or handle from the latch mechanism.

BACKGROUND OF THE INVENTION

A well-received magnetic key operated mechanism used in conjunction with a door lock is that described in U.S. Pat. No. 4,133,194 owned by Bruce S. Sedley, the owner and assignee of the present application. In the patented door lock, a magnetic card key operates a conventional cylindrical door lock with substantially no modification required of the lock, in that a housing for the door lock contains magnetically operated elements mounted on the conventional spindle of the lockset. In use, a properly coded card key is inserted into a slot in the outer rim of the door knob which effects interconnection between the door knob with a conventional driver bar for opening the lockset parts.

Although the patented device is satisfactory for most purposes, several disadvantages in use make improvement desirable. First of all, it is necessary to hold the card in the slot of the doorknob while turning the knob to keep the unlocking mechanism engaged. Furthermore, the necessary diameter of the knob used in the patented device is substantially larger than that of most door knobs which makes rotation awkward when a short backset is used. The latter aspect makes the patented device somewhat impractical for narrow stile doors of the aluminum and glass type which often utilize very short backsets.

Still further, the patented apparatus was designed contemplating mainly doorknob-type locksets and therefore could not easily be adapted for lever or handle operation now being specified in many construction projects to meet handicapped person codes.

OBJECTS AND SUMMARY OF THE INVENTION

It is a primary object and aim of the present invention to provide a magnetic key operated mechanism which can activate various devices such as a door lock in which the mechanism is incorporated within a housing mounted directly on the outer surface of the door with an access slot for the card key extending downwardly and generally parallel to the major surface of the door.

A further object of the invention is the provision of a magnetic key operated lock which can utilize either a conventional knob or lever arm handle.

Yet another object is to provide a lock which may be fixedly mounted for key insertion either from top, bottom or either side for shielding the slot from the elements or for the convenient access of the user.

Another object is to provide a mechanical card key operated lock which retains the card in the unlocked position so that the card can be released and the same hand used to rotate the knob or handle to unlock the door.

A further object is to provide a card key operated locking mechanism of small width for use on doors with short backsets.

Still a further object is the provision of a magnetic key operated lock which can be quickly and simply modified for changing a lock code.

Yet another object is the provision of a magnetic card key operated lock as in the previous objects in which once the lock is actuated to the unlocked mode it is automatically maintained unlocked until the card key is substantially fully removed from the lock.

The above object providing means to actuate and maintain electric switchable devices in either the "ON" or "OFF" state as long as the key remains substantially in the slot.

One example of the practice of the present invention is as it relates to a door lock. A housing is affixed to the door over the access opening to the door latch or bolt retracting mechanism that includes a slot in a top wall portion via which a coded card key can be inserted to bring into alignment coded magnetic areas on the card with magnetically responsive elements of the internal lock in order to unlock the locking mechanism and enable rotation of either a knob or lever arm to retract the latch or bolt to open the door. More particularly, on a properly coded card key being received within the housing slot, the card can then be moved further into the slot moving a spring actuator against a spline coupling to engage it with a spindle spline carried by a shaft interconnected with the knob or lever arm handle. When so engaged the lock mechanism is mechanically latched in unlocked position. The sliding spline coupling is integral with parts which interrelate with the door lock mechanism such that rotation of the knob or lever arm will now effect retraction of the door locking mechanism. Spring-loaded members separate the spline coupling and spindle spline when the magnetic card key is withdrawn from the housing slot thus disengaging the handle or knob from the latch or bolt retractor.

As a further aspect, once the internal lock mechanism in the housing is unlocked, it is maintained unlocked until the magnetic card has been substantially fully withdrawn from the lock housing.

DESCRIPTION OF A PREFERRED EMBODIMENT

Figure 1:
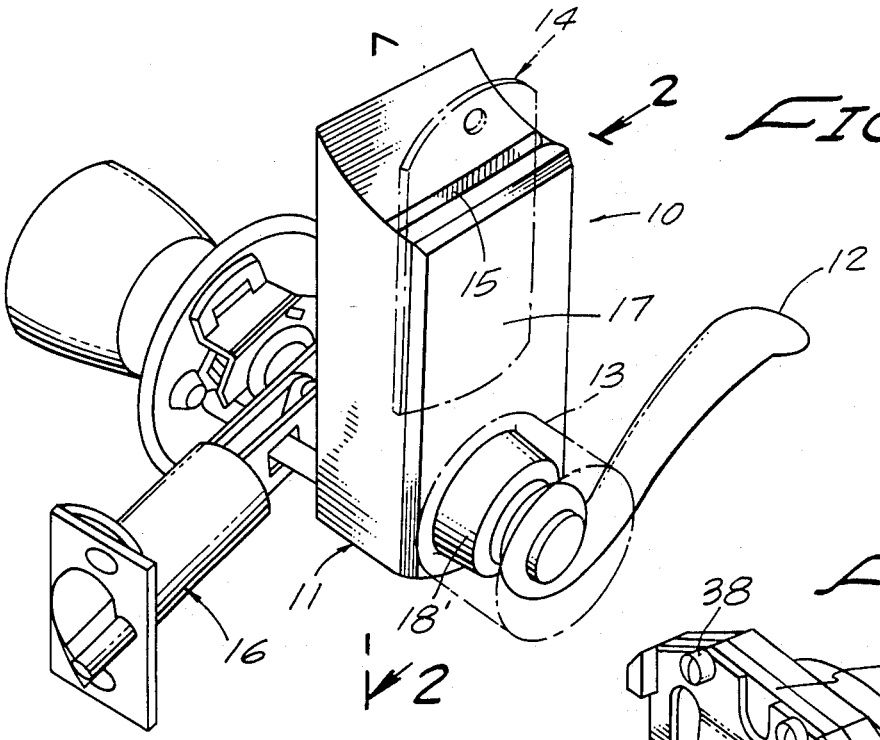
FIG. 1 is a perspective view of a complete coded card key lock mechanism and associated door lock latch hardware shown receiving a card key therein.

Turning now to the drawing and particularly FIG. 1, there is shown a magnetic coded card key operated locking mechanism to be described herein for mounting onto a door and enumerated generally as 10. More particularly, from the exterior the locking mechanism is seen to include a generally rectangular shaped housing 11 having a back surface for mounting flush to the door surface. The locking mechanism may be used with either a lever handle 12, or, optionally, a conventional knob shown schematically at 13.

As is more specifically described in U.S. Pat. No. 4,077,242, METAL MAGNETIC KEY, by Bruce S. Sedley, the key, which is in the general form of a card, has a predetermined arrangement of magnetic spots throughout its major area of a coded character which coact with apparatus in the internal locking mechanism for unlocking or releasing the locked condition of the door lockset.

An initial and important aspect of the described invention is that the card key 14 for unlocking the door is inserted through a slot 15 in a top wall of the housing 11 and that the key conveniently remains in this upright position throughout use so it cannot be easily inadvertently removed or displaced as can happen in certain known card operated devices where the cards are inserted through slotted knobs that are also turned. Although the slot is depicted and described as being located at the top of the housing, and there are certain advantages to such a location, the slot can readily be located in any of the housing walls, side, top or bottom. Also, as will be described, means are provided for maintaining the locking mechanism in unlocked mode once it has been unlocked and as long as the card remains inserted in the lock housing slot 15. These two features enable the entire apparatus to be handled by one hand since once the proper card is fully inserted, the same hand is then free to manipulate the knob or handle to open the door.

A still further advantageous feature of the present lock mechanism is that when it is in the locked mode, there are no mechanical linkages and interconnecting between the door latch 16 and handle 12 so that even if the handle were severed from the front of the housing 11, the latch mechanism cannot be rotated from the front of the door. This provides what is termed a "high security" lock as opposed to the less secure "door knob" locks, for example. Although a latch 16 is shown, the mechanism operates with bolts and other locking devices in similar manner.

Figure 2:
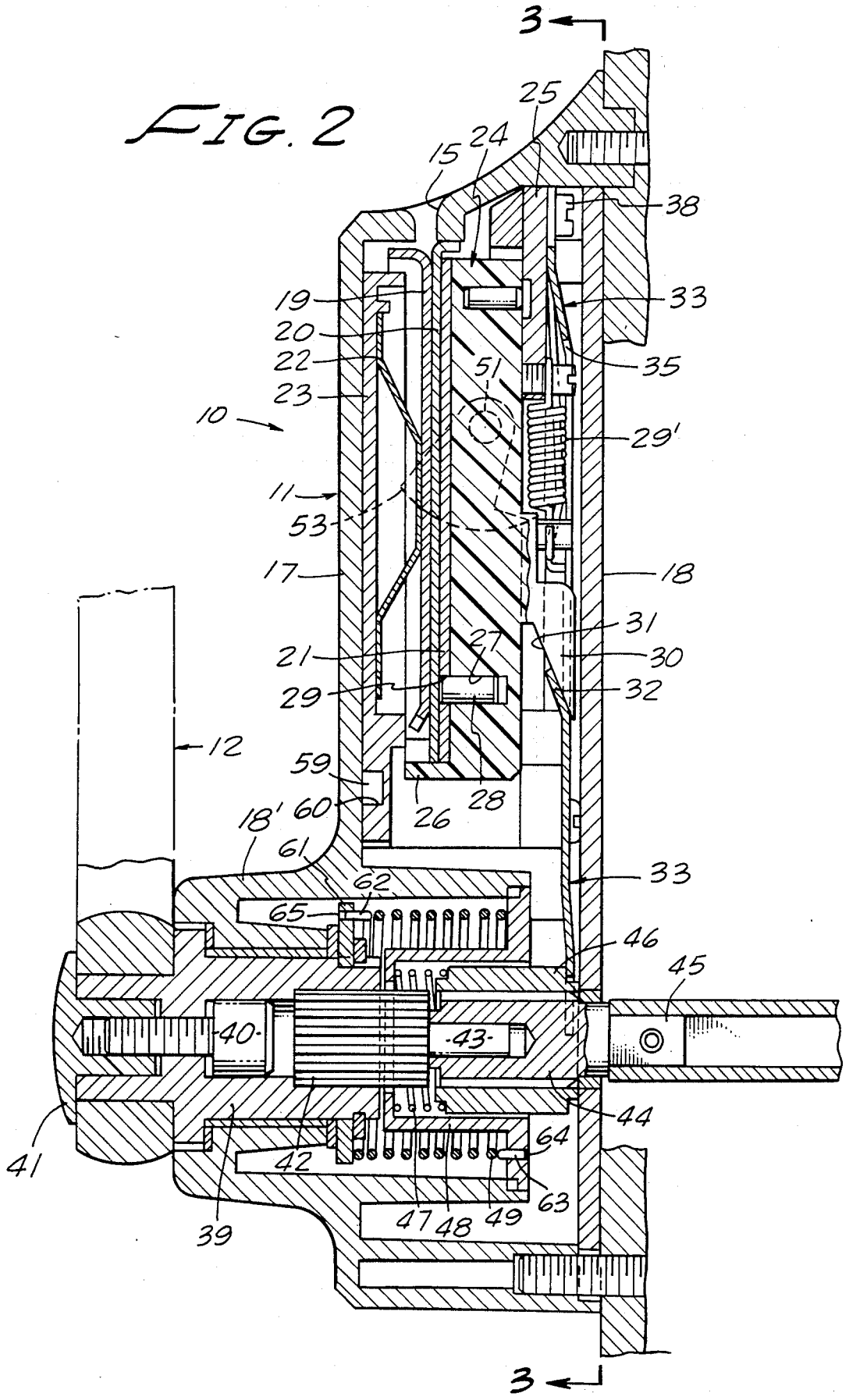
FIG. 2 is a side elevational, sectional view, taken along the line 2—2 of FIG. 1 showing the internal lock mechanism in the locked mode.

Turning now to FIG. 2 showing a side elevational, sectional view of FIG. 1, the housing 11 is seen to have a unitary front wall 17 and two side walls with an open back which is enclosed by rear plate 18. At what is the lower end of the lock housing when mounted on a door, there is a hollow cylindrical member 18' extending outwardly and inwardly of the housing front wall 17 and through which the handle spindle 39 and associated parts are mounted.

A magnetic card key 14 on being inserted through slot 15 passes between a pair of plates 19 and 20 arranged in facing relation. More particularly, the cover plate 20 is fixedly located over a so-called lock plate 21 to present a substantially flat surface along which one major surface of the card 14 can slide during card insertion. The shield plate 19 is resiliently urged toward the cover plate 20 by a leaf spring 22 located between a front module cover 23 and the shield plate.

Figure 4:
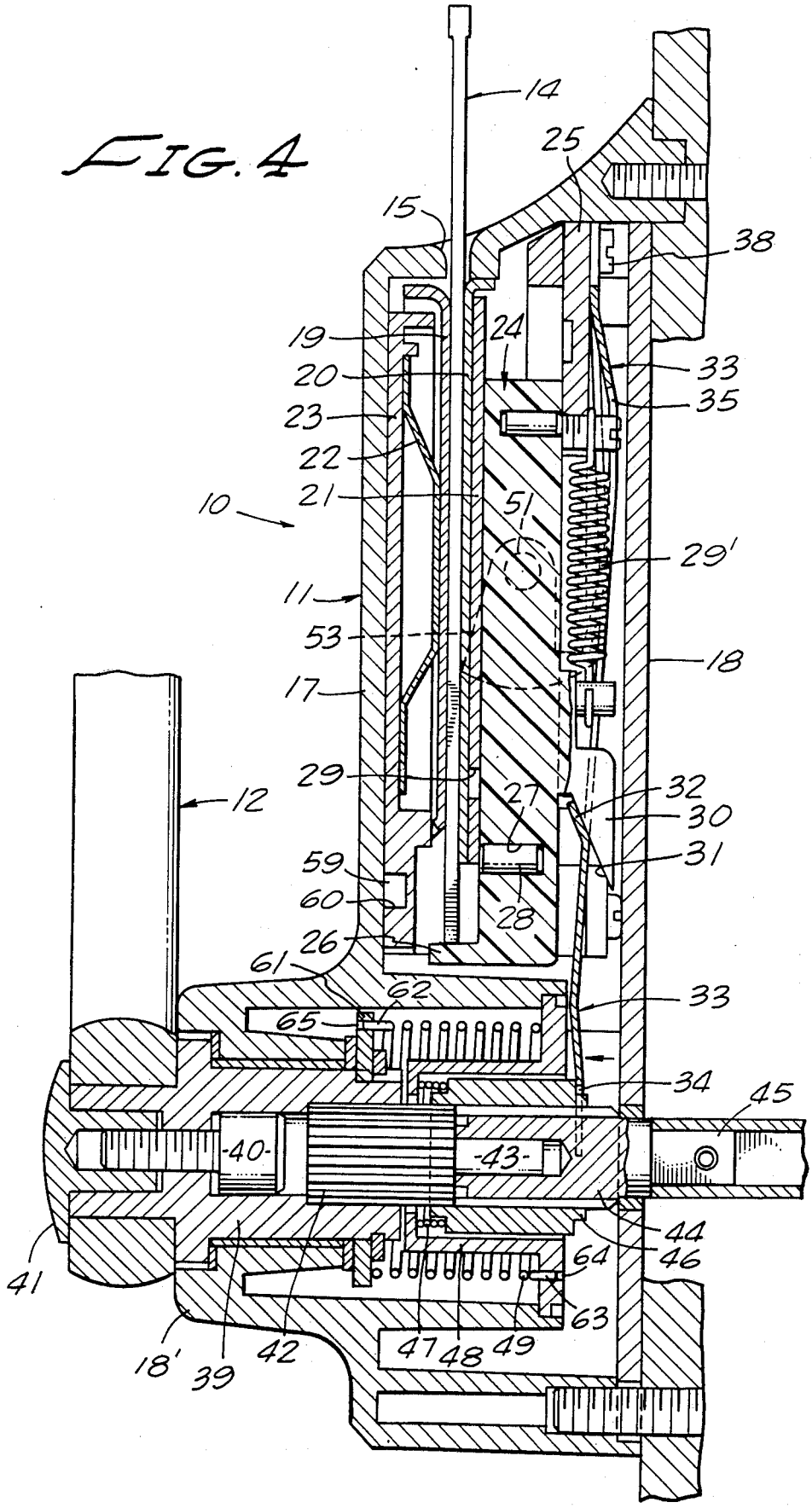
FIG. 4 is a sectional view similar to FIG. 2 showing the lock mechanism in the unlocked mode.

An elongated platelike actuator or core 24 is slidingly mounted onto a module back plate 25 enabling movement of the core from an uppermost position in which a flange 26 abuts against the lower end of the plates 20 and 21, to a second or lower position in which the flange is substantially spaced from the lower end of the plates (FIG. 4). The core has a plurality of openings 27 extending transversely into the core and at substantially 90 degrees to plate 21, which openings receive magnetically movable pins 28 in an arrangement and number depending upon the particular code of the lock. In the locked mode, the pins 28 extend into openings 29 in the lock plate 21 which prevents relative movement of the core with respect to the lock plate. When the properly coded card 14 is fully inserted between the plates 19 and 20, magnetic areas on the card cause those pins 28 in registry with the card magnetic areas to move axially to the bottom of the receiving openings 27 (i.e., in a direction away from plates 20 and 21) and out of corresponding openings in the lock plate 21 permitting the core to move from its upper position to its lower or released position. A coil spring 29' interconnected between the module back plate 25 and the core 24 tends to resiliently urge the core to its uppermost position or locked position acting in use to reset the locking mechanism to the locked mode upon removal of the card.

Figure 5:
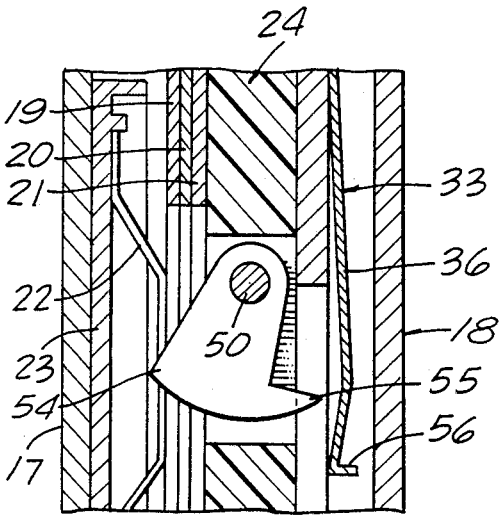
FIG. 5 is an enlarged sectional view of the means for maintaining unlocked condition of the locking mechanism before the card is inserted.
Figure 6:
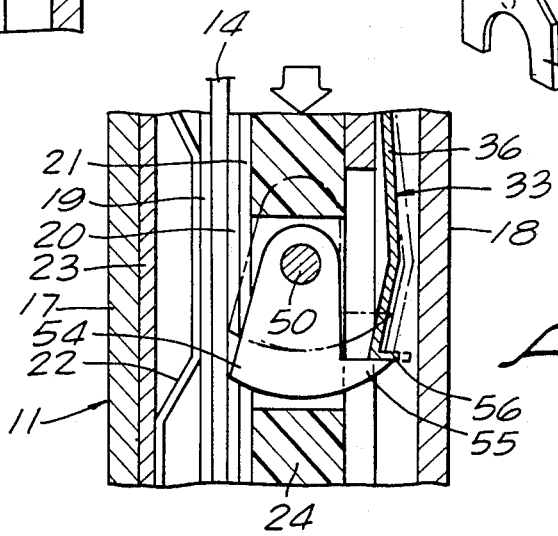
FIG. 6 is a sectional view similar to FIG. 5 showing changes as the card is inserted.

An impeller 30 on the rear surface of the core 24 (facing plate 18) has a downwardly directed beveled cam surface 31 which continuously engages an end portion 32 of a leaf spring 33. As can be seen best on comparison of FIGS. 2 and 3, the spring 33 is elongate with its lower edge formed into a yoke 34. The central part of the spring has an opening 35 through which the spring 29' extends, the lower edge of the opening being bent to form the end portion 32 which lies flat against the cam surface 31. Two elongated limit spring portions 36 and 37 extend downwardly from the top edge of spring 33, one at each side of the spring central portion and each terminating in a flanged end 56 (FIGS. 5 and 6). The upper edge of spring 33 is notched and secured to module back plate 25 by threaded means 38 so as to extend generally parallel to the back plate and core.

Again referring to FIG. 2, the door handle 12 is secured to a hollow cylindrical spindle 39 by an internal bolt 40 and external nut 41, the spindle being rotatively journaled within the housing cylindrical fitting 18'. A spindle spline 42 having longitudinally extending splines on its outer surface is press fit within a receiving opening in and axially aligned with spindle 39 while leaving a substantial end portion of the spline extending outwardly therefrom. An alignment rod 43 extends from the outer end of spline 42 along the spline cylindrical axis and is received within an axial opening of lock spline driver 44, the outer end of the latter identified as at 45 interconnecting with the door lock mechanism (not shown). The rod 43 rotates freely in the lock spline driver 44 and does not transfer an actuating force to the door latch mechanism.

A hollow coupling spindle 46 has an internal set of longitudinally extending splines which can mesh with the splines of the spindle 42. The outer end of the coupling 46 is formed to a reduced diametral portion of such dimensions as to enable receipt of the leaf spring yoke 34 thereabout. A compression spring 47 located within a guide tube 48 received about the coupling 46 urges the two apart in a direction generally along their common cylindrical axis.

A torsion spring 49 received on guide tube 48 acts to return the handle 12 to a predetermined initial position after the handle has been rotated to open the door, for example.

The outward end 63 of the spring 49 is fixed to the upper flange of guide tube 48 in hole 64. The flange can be rotatably fixed in various positions to bias the spring 49 either right or left. The opposite end 62 of spring 49 is fixed to the stop washer 61 in hole 65. The stop washer limits the rotation of handle spindle 39 and is fixed to it. Limit stop post 66 is affixed to housing 11.

With reference now to both FIGS. 2 and 4, it is seen that movement of the core 24 to its lowermost (released position) moves the cam surface 31 against the leaf spring end portion 32 causing spring yoke 34 to drive the coupling spline 46 into meshing engagement with the spindle spline 42. Now, there is a direct driving relationship between the handle 12 and the lock spline driver 44 enabling actuation of the door latch mechanism to open the door.

On the core moving upwardly again from the FIG. 4 position to that of FIG. 2, as happens when the card is removed, the reaction of the compression spring 47 moves the coupling spline out of engagement with the spindle spline which once again institutes the locked mode. The handle 12 is free to rotate, returning to its first position by spring 49. If knob 13 is installed instead of a handle, spring 49 is not used, stop washer 61 is replaced with a spacer washer without stop and the knob free spins in either direction.

By the use of a leaf spring as the drive linkage between core movement and the coupling spline 46, in the event that the splines on the coupling do not mesh with the splines on the spindle 42 (i.e., the splines bottom on each other), the leaf spring deforms a slight amount but maintains pressure so that even a very slight movement of the handle will quickly establish meshing between the two splines. The leaf spring does not retain a set even though held in stressed position.

Figure 3:
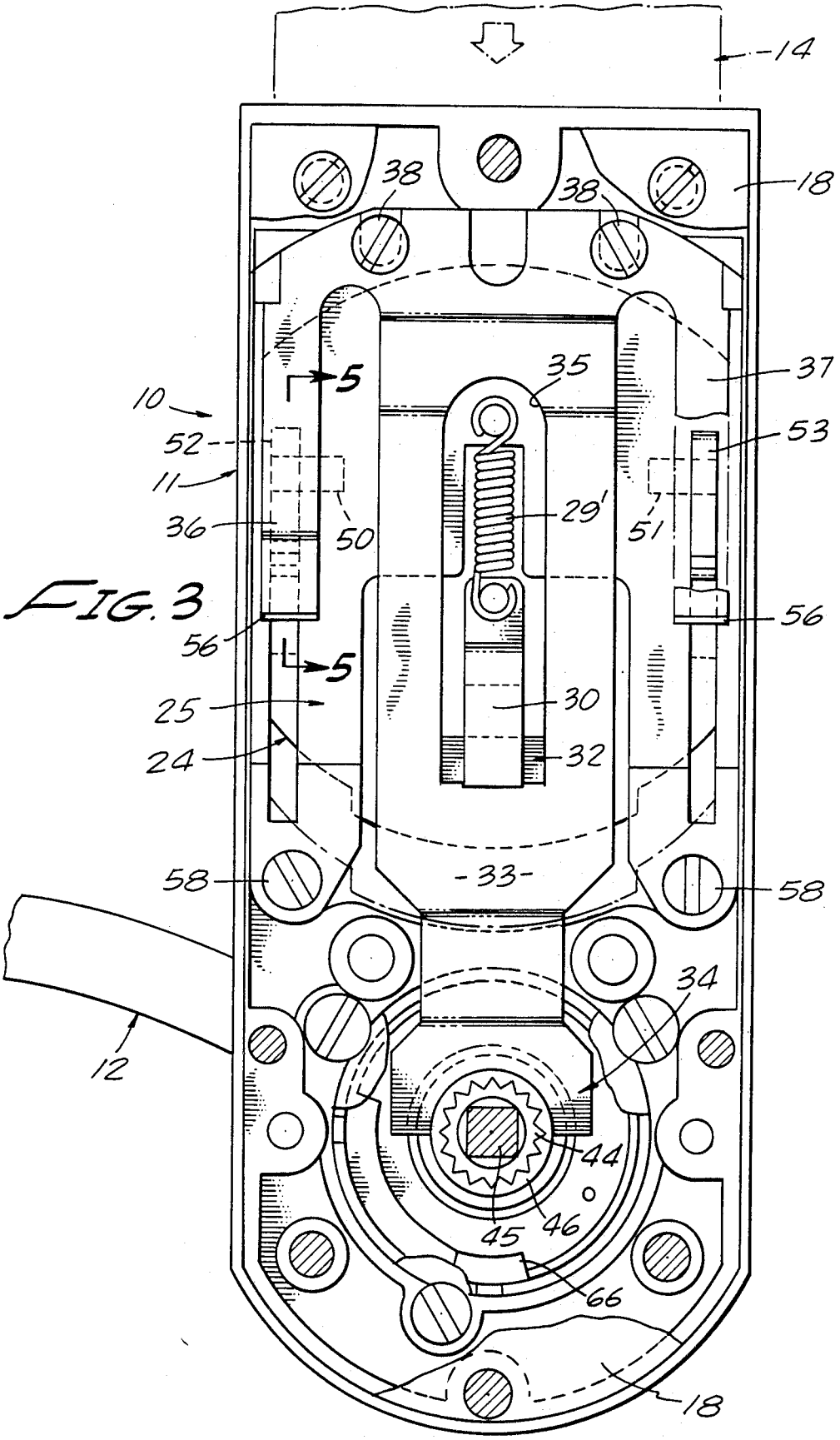
FIG. 3 is a rear elevational, sectional view taken along the line 3—3 of FIG. 2.

For the ensuing description of the means for maintaining the internal mechanism in the unlocked or released mode as long as the card 14 is in slot 15, reference is additionally made to FIG. 3 which is a rear elevational, sectional view of the apparatus of FIG. 2 and detail FIGS. 5 and 6. First and second stub shafts 50 and 51 are affixed to the sidewalls of the core 24 to extend generally parallel to plates 20 and 21. Each of the stub shafts has a pivotally mounted cam 52 and 53 respectively mounted thereon, each of which includes a camming surface 54 and a hook-like locking portion 55. Openings in plates 19, 20 and 21 admit the camming surface 54 therethrough for contacting engagement with a card 14 inserted between plates 19 and 20 which serves to move the two hooked end portions 55 toward leaf spring arms 36 and 37 for a purpose to be described.

As the card 14 moves through the slot 15 and between the plates 19 and 20, it engages the camming surfaces 54 of cams 52 and 53 moving the hook ends 55 toward the limit springs 36 and 37 as seen best in FIG. 6 for example. When the card abuts the core flange 26 and moves it downward, the core and cams are carried under the flanged ends 56 of limit springs 36 and 37 deflecting these springs a certain amount as indicated by the dash lines in FIG. 6. When the core flange 26 is bottomed in the lock mechanism the cam hook ends 55 engage the flanged ends 56 of the limit springs. As long as the proper card has been inserted to unlock the mechanism and it remains in place between the plates 19 and 20, the cams are held in position due to the thickness of the card blocking the cam slots in plates 19, 20 and 21. The core is therefore locked in the position which holds the splines 42 and 46 meshed with one another and, therefore, the door remains unlocked. When the card is withdrawn out of engagement with the cam surfaces 54, the core return spring 29' which has been exerting a pull on the core can now begin to retract the core back to locked position. In so moving, the cams are forced by the limit spring arms 36 and 37 to rotate once more into the space between the plates 19, 20 and 21 which releases the cam hook ends 55 from engagement with the flanged ends 56 of the limit springs. Now, the spring 29' continues to move the core upwardly which, in turn, pulls the beveled impeller 30 and cam surface 31 away from end portion 32 of leaf spring 33. Yoke 34 rises allowing coil spring 47 to push coupling spline 46 out of engagement with spindle spline 42 establishing the locking mode of the lock mechanism once again.

Figure 7:
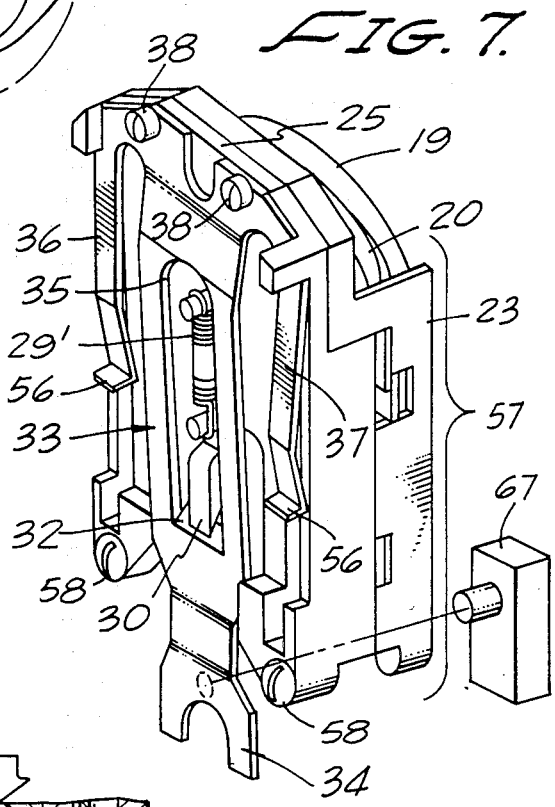
FIG. 7 is a perspective view of the locking mechanism module shown removed from the lock mechanism housing.

The various parts of the card lock mechanism including leaf spring and cams utilized for meshing the splines 42 and 46 to establish the released and locked modes, respectively, are assembled into a unitary module 57 as shown in FIG. 7. This module includes a module front cover 23, spring 22, plates 19, 20, 21, core 24 carrying code magnets 28 in recesses 27, side cams 52 and 53, module back plate 25, leaf spring 33 and coil spring 29', all held together by threaded means 38 and 58 (FIG. 2). Moreover, the module is so dimensioned as to fit snugly within housing 11 with the slot 15 aligned with the space between plates 19 and 20. The module 57 is retained in position in the housing 11 by registration pins 59 in aligned holes 60 in module front cover 23, and by the rear plate 18. The modular construction not only makes manufacturing assembly easier but also permits ready replacement in the field of the coded device.

A desirable feature of the module 57 is that by removing the leaf spring 33, core spring 29' and two screws 58, the coded core 24 can be removed for replacement of magnetic locking pins 28 without further disassembly of the remaining parts of the module 57.

The example described of the module 57 interacting with other components to function with door locking devices is just one embodiment of the use of the module. Equally useful is the modules' ability to actuate electric switch means as depicted in FIG. 7 wherein the leaf spring 33 is directly in contact with electric switch means 67 to actuate the same. The modules' ability to retain either locked or unlocked modes provides both "ON" and "OFF" switch functions depending on the card keys presence in the module.

It is therefore within the scope of this invention that its utility is not limited to door locks but to other mechanical and electrical devices requiring a card key operated actuation where such actuation is to continue as long as the card key remains in the module.

We claim:

1. In a card-operated lock apparatus having a locking plate with a plurality of openings therethrough in a predetermined arrangement, a core located adjacent the locking plate including a plurality of openings therein in said predetermined arrangement, magnetizable pins located within at least certain of the core openings and having parts magnetically biased to extend into the locking plate openings preventing relative movement between the core and locking plate, said pins being moved out of the locking plate openings on a card having coded magnetic areas being inserted on a first amount into alignment with the core and the effecting movement of the core corresponding to further card movement, the improvement comprising:

leaf spring means having a part thereof for contacting the core; and impeller means carried by said core for contacting said leaf spring means for moving the leaf spring means.

2. Apparatus as in claim 1, in which the impeller means moves the spring means transversely of the core movement direction relative to the locking plate.

3. Apparatus as in claim 1, in which there is further provided cam means pivotally mounted onto said core and having a first cam part for engagement by said card to releasably lock a second cam part against limit spring means for maintaining the core in unlocked position while the card is within the apparatus.

4. Apparatus as in claim 3, in which the limit spring means is integral with said leaf spring means.

5. Apparatus as in claim 1, in which the impeller means includes a beveled surface which contacts the leaf spring means for moving said leaf spring means.

6. Apparatus as in claim 3, in which the locking plate, core, cam means, magnetizable pins, leaf spring means, limit spring means, and impeller means are unitarily assembled to form a module.

7. Apparatus as in claim 6, in which said module further includes a front plate and a backplate and said leaf spring means are secured to the backplate.

8. Apparatus as in claim 7, in which there is further provided coil spring means interconnecting the core and backplate for resiliently urging the core and impeller means in a direction to return the core to locked position.

9. In apparatus for selectively meshing a spindle spline with a coupling spline interconnected with a door release mechanism including a housing for mounting on the door outer surface, a locking plate having a plurality of openings therethrough in a predetermined arrangement, a core located adjacent the locking plate having a plurality of openings therein in said predetermined arrangement, magnetizable pins located within at least certain of the core openings and having parts magnetically biased to extend into the locking plate openings preventing relative movement between the core and locking plate, said pins being moved out of the locking plate openings by a card having coded magnetic areas being inserted a first amount through a slot in said housing enabling movement of the core corresponding to further card movement, the improvement comprising:

leaf spring means having a part thereof for contacting the coupling spline; and impeller means carried by the core for moving said leaf spring means and coupling spline to effect meshing and unmeshing of the coupling spline with the spindle spline depending upon the direction of core movement.

10. Apparatus as in claim 9, in which the leaf spring means part includes a yoke that is received about the coupling spline.

11. Apparatus as in claim 9, in which the housing slot is located so that the card on being inserted therein moves generally downwardly.

12. Apparatus as in claim 9, in which unmeshing of the coupling spline and spindle spline is effected by reactive force of a spring.

13. Apparatus as in claim 9, in which a further spring is connected to the spindle spline continuously urging said spindle spline to a predetermined angular position.

14. Apparatus as in claim 13, in which a stop washer on the spindle spline limits travel of the spindle spline responsive to spring urging.

15. Apparatus as in claim 9, in which the spindle spline is free from mechanical connection with the coupling spline when the card is removed from the apparatus.

16. Apparatus as in claim 9, in which the leaf spring means resiliently urges the coupling spline toward the spindle spline enabling limited rotation of said spindle spline about the spline axis to aid meshing.

17. Apparatus as in claim 9, in which the slot and core are so arranged that when the card is inserted in said slot the card major surface is substantially parallel to the door major surface.

18. Apparatus as in claim 9, in which the impeller means is beveled and moves the leaf spring means transversely of the core movement direction relative to the locking plate.

19. Apparatus as in claim 9, in which there is further provided cam means pivotally mounted onto said core and having a first cam part for engagement by said card to releasably lock a second cam part against limit spring means for maintaining the core in unlocked position while the card is within the apparatus.

20. Apparatus as in claim 19, in which the limit spring means is integral with said leaf spring means.

21. Apparatus as in claim 19, in which the locking plate, core, cam means, magnetizable pins, leaf spring means, limit spring means and impeller means are unitarily assembled to form a module.

22. Apparatus as in claim 21, in which said module further includes a front plate and a backplate and said leaf spring means are secured to the backplate.

23. Apparatus as in claim 22, in which there is further provided coil spring means interconnecting the core and backplate for resiliently urging the core and impeller means in a direction to return the core to locked position.

24. Apparatus as in claim 21, in which the leaf spring means, limit spring means, coil spring means, cam means and core are removable from the module without disassembling the remaining module parts.

25. In a card-operated lock apparatus having a locking plate with a plurality of openings therethrough in a predetermined arrangement, a core located adjacent the locking plate including a plurality of openings therein in said predetermined arrangement, magnetizable pins located within at least certain of the core openings and having parts magnetically biased to extend into the locking plate openings preventing relative movement between the core and locking plate, said pins being moved out of the locking plate openings by a card having coded magnetic areas being inserted a first amount through a slot in said housing enabling movement of the core corresponding to further card movement, the improvement comprising:

leaf spring means having a part thereof for contacting the core;

impeller means carried by said core for contacting said leaf spring means for moving the leaf spring means; and electric switch means actuated by the leaf spring movement on the card further movement to a first connective aspect and actuated to a second connective aspect when the card is removed from the apparatus.

* * * * *